US005723428A

United States Patent [19]

Boskamp et al.

[11] Patent Number: 5,723,428

[45] Date of Patent: Mar. 3, 1998

[54] DETERGENT COMPOSITIONS AND PROCESS FOR PREPARING THEM

[75] Inventors: Jelles Vincent Boskamp, Vlaardingen; Timothy Richard Bundy, Rotterdam, both of Netherlands; Marilena Coruzzi, Piacenza, Italy; Pauline Farnworth, Merseyside, Great Britain; Mark Phillip Houghton, Berkel en Rodenrijs; Christophe Joyeux, Rotterdam, both of Netherlands; Peter Cory Knight, Cheshire, Great Britain; Leandre Naddeo, Milan, Italy; Alistair Richard Sanderson, Cheshire, Great Britain

[73] Assignee: Lever Brothers Company, New York, N.Y.

[21] Appl. No.: 643,086

[22] Filed: May 2, 1996

Related U.S. Application Data

[63] Continuation of Ser. No. 340,911, Nov. 17, 1994, abandoned.

[30] Foreign Application Priority Data

Nov. 24, 1993 [GB] United Kingdom ..... 9324129

[51] Int. Cl.[6] ..... C11D 17/00; C11D 3/02

[52] U.S. Cl. ..... 510/481; 510/491; 510/507; 510/509; 510/518; 510/353; 510/355; 510/358; 510/367

[58] Field of Search ..... 510/481, 491, 510/507, 509, 518, 353, 355, 358, 367

[56] References Cited

U.S. PATENT DOCUMENTS

| | | | |
|---|---|---|---|
| 4,240,920 | 12/1980 | de Luque | 252/99 |
| 4,303,556 | 12/1981 | Llendado | 252/527 |
| 4,406,808 | 9/1983 | Gangwisch et al. | 252/91 |
| 4,751,015 | 6/1988 | Humphreys et al. . | |
| 4,818,426 | 4/1989 | Humphreys et al. . | |
| 4,988,451 | 1/1991 | Nunn et al. | 252/95 |
| 5,132,036 | 7/1992 | Falou et al. | 252/99 |
| 5,238,594 | 8/1993 | Chapple | 252/95 |
| 5,314,635 | 5/1994 | Hage et al. | 252/98 |
| 5,354,493 | 10/1994 | Wilms | 252/174.21 |
| 5,393,455 | 2/1995 | Poethkow et al. | 252/135 |

FOREIGN PATENT DOCUMENTS

| | | | |
|---|---|---|---|
| 0 265 203 | 4/1978 | European Pat. Off. | C11D 1/83 |
| 0 001 853 | 5/1979 | European Pat. Off. | C11D 3/06 |
| 0 284 292 | 9/1988 | European Pat. Off. | C11D 3/39 |
| 0 303 520 | 2/1989 | European Pat. Off. | C11D 3/39 |
| 0 313 143 | 4/1989 | European Pat. Off. | C11D 3/395 |
| 0 313 144 | 4/1989 | European Pat. Off. | C11D 3/395 |
| 0 326 208 | 8/1989 | European Pat. Off. | C11D 17/04 |
| 0 344 629 | 12/1989 | European Pat. Off. | C11D 17/00 |
| 0 349 201 | 1/1990 | European Pat. Off. | C11D 11/00 |
| 0 364 881 | 4/1990 | European Pat. Off. | C11D 3/72 |
| 0 384 070 | 8/1990 | European Pat. Off. | C11D 3/12 |
| 0 402971 | 12/1990 | European Pat. Off. | C11D 3/39 |
| 0 420 317 | 4/1991 | European Pat. Off. | C11D 17/06 |
| 0 425 277 | 5/1991 | European Pat. Off. | C11D 17/06 |
| 0 439 316 | 7/1991 | European Pat. Off. | C11D 11/14 |
| 0 451 894 | 10/1991 | European Pat. Off. | C11D 10/04 |
| 0 456 315 | 11/1991 | European Pat. Off. | C11D 3/12 |
| 0 460 925 | 12/1991 | European Pat. Off. | C11D 1/14 |
| 0 506 184 | 9/1992 | European Pat. Off. | C11D 11/04 |
| 0 507 402 | 10/1992 | European Pat. Off. | C11D 11/04 |
| 0 512 552 | 11/1992 | European Pat. Off. | C11D 17/06 |
| 0 521 635 | 1/1993 | European Pat. Off. | C11D 3/12 |
| 0 522 726 | 1/1993 | European Pat. Off. | C11D 3/12 |
| 0 534 525 | 3/1993 | European Pat. Off. | C11D 3/10 |
| 0 544 492 | 6/1993 | European Pat. Off. | C11D 17/06 |
| 544492 | 6/1993 | European Pat. Off. | C11D 17/06 |
| 0 578 871 | 1/1994 | European Pat. Off. | C11D 3/12 |
| 2 336 182 | 5/1979 | Germany | C11D 3/20 |
| 2 401 062 | 3/1986 | Germany | C11D 3/20 |
| 3 002 428 | 2/1990 | Germany | C11D 1/22 |
| 1 323 670 | 7/1973 | United Kingdom | C11D 3/20 |
| 1 325 645 | 8/1973 | United Kingdom | C11D 7/54 |
| 1 379 734 | 1/1975 | United Kingdom | C11D 3/60 |
| 1 381 187 | 1/1975 | United Kingdom | C11D 3/60 |
| 1 408 678 | 10/1975 | United Kingdom | C11D 1/02 |
| 1 427 071 | 3/1976 | United Kingdom | C11D 10/02 |
| 1 429 143 | 3/1976 | United Kingdom | C11D 10/02 |
| 2 047 264 | 11/1980 | United Kingdom | C11D 10/04 |
| 2 095 274 | 9/1982 | United Kingdom | C11D 3/08 |
| 2 041 394 | 11/1982 | United Kingdom | C11D 3/00 |
| 2 106 482 | 4/1983 | United Kingdom | C11D 17/00 |
| WO91/15566 | 10/1991 | WIPO | C11D 11/00 |
| WO94/28098 | 12/1994 | WIPO | C11D 3/12 |
| WO94/28109 | 12/1994 | WIPO | C11D 17/06 |

OTHER PUBLICATIONS

International Search Report in International Patent Application EP 94/03612.

Great Britain Search Report in Great Britain Patent Application 9324129.7.

Co–pending application Ser. No. 08/340,969.

"Surface Active Agents and Detergents", Schwartz, Perry & Berch, vols. I and II, (Interscience Publishers Inc., New York, 1958).

Great Britain Search Report in Great Britain Patent Application 9324128.9.

A copy of the Great Britain Search Report in Great Britain Patent Application 9324128.9 is enclosed.

International Search Report in International Patent Application PCT/EP 94/03613.

*Primary Examiner*—Glenn Caldarola
*Assistant Examiner*—Patricia L. Hailey
*Attorney, Agent, or Firm*—Rimma Mitelman

[57] ABSTRACT

Particulate high bulk density non-spray-dried detergent compositions containing organic non-soap surfactant, zeolite builder and fatty acid soap as powder structurant, prepared by non-tower mixing and granulation processes involving in-situ neutralization of fatty acid to soap with aqueous sodium hydroxide, can suffer from localized particle yellowing on storage when perfume and/or fluorescer are present, due to the presence of areas of high alkalinity. Yellowing is reduced without loss of powder structuring if a defined, less than stoichiometric amount of sodium hydroxide is used for the fatty acid neutralization. Surprisingly, in bleaching powders improved bleach stability is also observed. The resulting powder can be defined in terms of a low "basic sodium" content.

13 Claims, No Drawings

DETERGENT COMPOSITIONS AND PROCESS FOR PREPARING THEM

This is a continuation of Ser. No. 08/340,911, filed Nov. 17, 1994 , now abandoned.

TECHNICAL FIELD

The present invention relates to granular detergent compositions of high bulk density containing organic non-soap surfactants, zeolite builder, and fatty acid soaps; and to a mixing and granulation (non-spray-drying) process for preparing them.

BACKGROUND AND PRIOR ART

Recently there has been considerable and increasing interest within the detergents industry in the production of detergent powders having a high bulk density, and these are tending to supersede the traditional porous spray-dried powders. High bulk density powders may be made either by post-tower densification of spray-dried powder, or by wholly non-tower routes involving dry-mixing, agglomeration, granulation and similar processes. The present invention is concerned especially with powders prepared by wholly non-tower granulation processes.

EP 544 492A (Unilever) discloses detergent compositions of high bulk density. These compositions comprise a base powder containing anionic surfactant (sodium primary alcohol sulphate, NaPAS) and nonionic surfactants, sodium aluminosilicate (zeolite) builder, sodium carbonate and a low level (generally about 2 wt %) of fatty acid soap; to the base powder are admixed (postdosed) ingredients such as further nonionic surfactant, bleaching persalts, bleach precursors and bleach stabilisers, enzyme granules, foam control granules and perfume.

The base powder may be prepared by mixing and granulating in a high-speed mixer/granulator (high-speed mixer/densifier) which combines high-speed stirring and cutting actions.

The function of the fatty acid soap in the base powder ms to act as a powder structurant, that is to say, to hold the granules together and provide a crisp, free-flowing product. It is preferably incorporated in free fatty acid form, and neutralised at some stage during the mixing and granulating process by sodium hydroxide.

In the known processes, sodium hydroxide has always been provided in the calculated stoichiometric amount required to effect full neutralisation of the fatty acid. However, there are other sources of alkalinity in the base powder formulation, for example, sodium aluminosilicate builder, sodium carbonate if present, and sodium carboxymethylcellulose, and in practice the final product will tend to contain localised regions of excess alkalinity. This can cause localised discoloration of the product, particularly yellowing, where alkali-sensitive ingredients such as fluorescer or perfume are present. This manifests itself as the yellowing of some particles within the powder, the number of yellow particles and the intensity of their colour increasing with time.

The present inventors therefore carried out an investigation to determine whether or not the amount of sodium hydroxide could be reduced. It was found that reduction to half the stoichiometric requirement gave products that had poor powder properties: flow was reduced, average particle size was larger, while the percentage of "fines" (particles smaller than 180 micrometers) also increased. Delivery to the wash, dissolution and residues on washed articles were also detrimentally affected. Evidently, not enough of the fatty acid was being converted to soap to provide adequate powder structuring.

Further experimentation, however, established that there is a window within which the yellowing problem could be solved without detriment to powder properties.

Surprisingly, it was also found that base powders in which the fatty acid had been neutralised with a less than stoichiometric amount of sodium hydroxide showed a further benefit when combined with peroxy bleaching ingredients: the storage stability of certain bleach ingredients, notably sodium percarbonate and the bleach precursor tetraacetylethylenediamine, was substantially improved.

DEFINITION OF THE INVENTION

In its product aspect, the present invention accordingly provides a particulate detergent composition having a bulk density of at least 600 g/l which comprises a substantially homogeneous granular base which is not the product of a spray-drying process and which comprises:

(a) an organic non-soap surfactant system, (b) a builder system comprising sodium aluminosilicate, (c) sodium fatty acid soap, (d) optional sodium carbonate, (d) water and optional minor ingredients, the granular base having a level of "basic sodium" (as defined below) not exceeding 0.4 wt %.

In its process aspect, the present invention provides a process for the preparation of a particulate detergent composition having a bulk density of at least 600 g/l, which comprises mixing and granulating (i) one of more organic non-soap surfactants, optionally including one or more anionic surfactants in free acid form, (ii) one or more detergency builders comprising sodium aluminosilicate, (iii) fatty acid, (iv) optionally sodium carbonate, (v) optionally water and minor detergent ingredients, (vi) sodium hydroxide in an amount equal to not more than 0.90 times the stoichiometric amount required to neutralise the fatty acid, whereby a substantially homogeneous granular detergent base composition having a bulk density of at least 600 g/l is formed, whereby neutralisation of the fatty acid to soap is effected, and whereby any anionic surfactant initially present in free acid form is converted to sodium salt form;

and optionally admixing further detergent ingredients to form a product.

DETAILED DESCRIPTION OF THE INVENTION

The invention addresses the problem of achieving good powder structuring in a detergent base powder by means of fatty acid soap produced by in-situ neutralisation during a non-tower process, while avoiding the generation of areas of localised high alkalinity that can cause discoloration of sensitive ingredients such as perfume or fluorescer.

The solution provided by the invention is to identify, for a particular formulation, a window of extent of neutralisation of the fatty acid within which localised high alkalinity is avoided without detriment to powder structuring. Powders in accordance with the invention also have better delivery, dispersion, and dissolution characteristics in the wash.

As previously indicated, it has surprisingly been found that base powders in accordance with the invention also give a further benefit, when combined with postdosed bleach ingredients to form a product: storage stability of the bleach ingredients is improved. This second benefit operates also at extents of neutralisation of the fatty acid which are below the optimum value for powder properties; however powder properties could in principle be recovered by suitable adjustment of the formulation or of the processing conditions. However, within the preferred operating window mentioned above, all benefits are obtained without the need to alter the formulation or the processing conditions.

In the process of the invention, this operating window can be defined in terms of the amount of sodium hydroxide used as a proportion of the stoichiometric amount required. For reduced fluorescer yellowing and improved bleach stability, it should not exceed 0.90 times the stoichiometric amount; to achieve these benefits and maintain optimum powder properties without the need for formulation or process adjustments, the amount of sodium hydroxide preferably amounts to from 0.60 to 0.90, and more preferably from 0.65 to 0.85, of the stoichiometric amount.

In product terms, the amount of excess alkalinity or level of "basic sodium" defines base powders in accordance with the invention. As used in the present specification, the term "basic sodium" means the amount of sodium ion associated with the basic anions, hydroxide and carbonate, that can be recovered from a solution of the base powder.

This represents the sodium ion present over and above that accounted for as counter-cation to any anionic species present in the formulation, other than the "basic" anions, hydroxyl or carbonate.

The total dissolved sodium in a solution of the powder may be determined by atomic absorption spectroscopy, as described in more detail in the Examples below. The content of basic anions is readily determinable by titration, and the equivalent amount of sodium, representing the "basic sodium", may then be calculated. This may be done whether or not exact formulation details are known.

The total sodium content, and the total content of anionic material, of a known formulation can also be calculated from the amounts of the various raw materials present. The excess, which remains associated with hydroxide or carbonate anions, is the "basic sodium".

For a known formulation containing zeolite, a discrepancy between measured and calculated values may be observed, the measured values being slightly higher. This can be attributed to residual soluble sodium (as sodium hydroxide) associated with the zeolite raw material, and not accounted for in the calculations.

For improved bleach stability and reduced fluorescer yellowing, the substantially homogeneous granular base of the detergent composition of the invention has a measured "basic sodium" level not exceeding 0.4 wt %; in order that powder properties also be maintained without the need for formulation or processing adjustments, the "basic sodium" level preferably lies within the range of from 0.25 to 0.4 wt %, more preferably from 0.3 to 0.4 wt %, and desirably from 0.31 to 0.39 wt %.

Detergent base powders

The composition of the invention includes, or may consists wholly of, a so-called detergent base powder, that is to say, a substantially homogeneous granular material prepared by a granulation or agglomeration process, in which all particles are substantially alike. Liquid ingredients such as perfume or nonionic surfactant may be sprayed on subsequently without destroying this basic homogeneity.

The base powder may be admixed with other particulate materials, such as bleaching ingredients, enzyme granules, or foam control granules, as is customary in the industry, and the resulting product is clearly heterogeneous. The "basic sodium" values characteristic of the invention, however, refer to the base powder before admixture of such ingredients.

Any final, heterogeneous product containing a base powder of the invention is itself a further subject of the invention.

In a finished product, base powder granules may readily be separated from admixed particulate material to allow the "basic sodium" level to be measured.

Preferred detergent base powders in accordance with the invention comprise:

(a) from 10 to 50 wt % of the organic surfactant system, (b) from 5 to 80 wt % of the builder system, comprising from 10 to 70 wt % of sodium aluminosilicate, (c) from 1 to 10 wt %, preferably from 1 to 5 wt %, of fatty acid soap, (d) from 0 to 20 wt % of sodium carbonate, (e) water and optional minor ingredients to 100 wt %.

The base powders of the invention exhibit excellent powder properties (flow, average particle size, particle size distribution) and also good delivery, dispersion and dissolution characteristics in the wash.

Detergent compositions

Preferred detergent compositions in accordance with the invention may suitably comprise:

(i) from 40 to 95 wt % of the homogeneous granular base, (ii) optionally from 5 to 35 wt % of a peroxy bleach compound, (iii) optionally from 1 to 8 wt % of a peracid precursor, (iv) optionally from 0.01 to 1 wt % of a fluorescer, optionally within the homogeneous granular base, (v) optional minor ingredients to 100 wt %.

Organic surfactant system

The surfactant(s) constituting the organic (non-soap) surfactant system may be chosen from the many suitable detergent-active compounds available. These are fully described in the literature, for example, in "Surface-Active Agents and Detergents", Volumes I and II, by Schwartz, Perry and Berch.

Anionic surfactants are well-known to those skilled in the art. Examples include alkylbenzene sulphonates, particularly linear alkylbenzene sulphonates having an alkyl chain length of $C_8$-$C_{15}$; primary and secondary alkyl sulphates, particularly $C_8$-$C_{24}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$-$C_{20}$ aliphatic alcohols ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

The invention is especially applicable to compositions in which the surfactant system includes an ethoxylated nonionic surfactant, and/or an anionic sulphonate or sulphate type surfactant. Especially preferred are compositions containing ethoxylated nonionic surfactant alone, or primary alcohol sulphate (PAS) and/or linear alkylbenzene sulphonate (LAS), or ethoxylated nonionic surfactant in combination with PAS and/or LAS.

Detergency builder

The compositions of the invention contain a sodium aluminosilicate builder. Sodium aluminosilicates may generally be incorporated in amounts of from 5 to 70% by weight (anhydrous basis) of the base powder, preferably from 25 to 60 wt %. Suitably, in a heavy duty detergent composition, the aluminosilicate constitutes from 25 to 48 wt % of the final product.

The alkali metal aluminosilicate may be either crystalline or amorphous or mixtures thereof, having the general formula:

$0.8–1.5\ Na_2O.Al_2O_3.0.8–6\ SiO_2$

These materials contain some bound water and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature.

Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof.

The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP 384 070A (Unilever). Zeolite MAP is defined as an alkali metal aluminosilicate of the zeolite P type having a silicon to aluminium ratio not exceeding 1.33, preferably within the range of from 0.90 to 1.33, and more preferably within the range of from 0.90 to 1.20.

Especially preferred is zeolite MAP having a silicon to aluminium ratio not exceeding 1.07, more preferably about 1.00. The calcium binding capacity of zeolite MAP is generally at least 150 mg CaO per g of anhydrous material.

Other builders may also be included in the detergent compositions of the invention as necessary or desired.

Especially preferred supplementary builders are polycarboxylate polymers, more especially polyacrylates and acrylic/maleic copolymers, suitably used in amounts of from 0.5 to 15 wt %, especially from 1 to 10 wt %; and monomeric polycarboxylates, more especially citric acid and its salts, suitably used in amounts of from 3 to 35 wt %, more preferably from 5 to 30 wt %.

Fluorescer and perfume

As indicated previously, the benefits of the invention are especially apparent when the final product includes materials that are alkali-sensitive, for example, fluorescer, perfume. In such products localised yellowing due to areas of high alkalinity is eliminated or greatly reduced when the "basic sodium" level of the base powder is controlled in accordance with the present invention.

Any fluorescer (optical brightener) suitable for use in a detergent powder may be used in the present invention. The most commonly used fluorescers are those belonging to the classes of diaminostilbene-sulphonic acid derivatives, diarylpyrazoline derivatives, and bisphenyl-distyryl derivatives.

Examples of the diaminostilbene-sulphonic acid derivative type of fluorescer include disodium 4,4'-bis-(2-diethanolamino-4-anilino-s-triazin-6-ylamino) stilbene-2:2'-disulphonate, disodium 4,4'-bis-(2-morpholino-4- anilino-s-triazin-6-ylaminostilbene-2:2'-disulphonate, disodium 4,4'-bis-(2,4-dianilino-s-triazin-6-ylamino) stilbene-2:2'-disulphonate, disodium 4,4'-bis-(2 anilino-4-(N-methyl-N-2-hydroxyethylamino)-s-triazin-6-ylamino) stilbene-2,2'-disulphonate, disodium 4,4'-bis-(4-phenyl-2,1,3-triazol-2-yl) stilbene-2,2'- disulphonate, disodium4,4'-bis(2-anilino-4-(1-methyl-2- hydroxyethylamino)-s-triazin-6-ylamino) stilbene-2,2'- disulphonate and sodium 2-(stilbyl-4"-naptho-1', 2':4,5)- 1,2,3-triazole-2"-sulphonate.

Other fluorescers suitable for use in the invention include the 1,3-diaryl pyrazolines and 7-alkylaminocoumarins.

Fluorescer is suitably present in an amount within the range of from 0.01 to 1 wt %, preferably from 0.02 to 0.8 wt %, and more preferably from 0.03 to 0.5 wt %.

Fluorescer may be included in the base powder itself, or may be postdosed, either as such or in granular form on a particulate carrier material. If desired, a combined granule containing fluorescer and other ingredients, for example, antifoam, on a common carrier, may be postdosed. Perfume will generally be postdosed (sprayed on), after addition of any other postdosed ingredients.

Bleach ingredients

The benefits of the invention are also especially apparent when the final product includes peroxy bleach compounds, for example, inorganic persalts or organic peroxyacids, capable of yielding hydrogen peroxide in aqueous solution.

Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate.

The invention is especially applicable to compositions containing sodium percarbonate, which is notoriously unstable on storage. If desired, the sodium percarbonate may have a protective coating against destabilisation by moisture. Sodium percarbonate having a protective coating comprising sodium metaborate and sodium silicate is disclosed in GB 2 123 044B (Kao).

The peroxy bleach compound is suitably present in an amount of from 5 to 35 wt %, preferably from 10 to 25 wt %, based on the final product.

The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %.

Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'-tetracetyl ethylenediamine (TAED).

The novel quaternary ammonium and phosphonium bleach precursors disclosed in U.S. Pat. No. 4,751,015 and U.S. Pat. No. 4,818,426 (Lever Brothers Company) and EP 402 971A (Unilever) are also of great interest. Especially preferred are peroxycarbonic acid precursors, in particular cholyl-4-sulphophenyl carbonate.

Also of interest are peroxybenzoic acid precursors, in particular, N,N,N-trimethylammonium toluoyloxy benzene sulphonate; and the cationic bleach precursors disclosed in EP 284 292A and EP 303 520A (Kao).

A bleach stabiliser (heavy metal sequestrant) may also be present. Suitable bleach stabilisers include ethylenediamine tetraacetate (EDTA) and the polyphosphonates such as Dequest (Trade Mark), EDTMP.

An especially preferred bleach system comprises a peroxy bleach compound,preferably sodium percarbonate, together with the bleach activator TAED.

Fatty acid soap

The detergent base powders of the invention contain as an essential ingredient a fatty acid sodium soap, prepared by in situ neutralisation with sodium hydroxide in a defined amount in accordance with the invention. The soap is suitably present in an amount of from 1 to 10 wt %, preferably from 1 to 5 wt %, of the base powder. Soaps of $C_{8-20}$ saturated or unsaturated fatty acids may for example be used, soaps of predominantly $C_{12-18}$ saturated fatty acids generally being preferred.

Other ingredients

The compositions in accordance with the invention may contain sodium carbonate, to increase detergency and to ease processing, although this is not essential. Sodium carbonate, which may be included in the base powder, postdosed or both, may generally be present in amounts ranging from 1 to 60 wt %, preferably from 2 to 40 wt %, and most suitably from 2 to 13 wt %.

Other ingredients which may be present in the base powder include sodium silicate; antiredeposition agents such as cellulosic polymers.

Optional ingredients that may generally be admixed (postdosed) to give a final product include, as well as those already mentioned, proteolytic and lipolytic enzymes; dyes; foam control granules; coloured speckles; and fabric softening compounds. This list is not intended to be exhaustive.

The process

The high bulk density detergent base powders of the invention are prepared by non-tower (non-spray-drying) processes in which solid and liquid ingredients are mixed and granulated together.

Advantageously, the mixing and granulation process is carried out in a high-speed mixer/granulator having both a stirring and a cutting action. The high-speed mixer/granulator, also known as a high-speed mixer/densifier, may be a batch machine such as the Fukae (Trade Mark) FS, or a continuous machine such as the Lödige (Trade Mark) Recycler CB30.

Suitable processes are described, for example, in EP 544 492A, EP 420 317A and EP 506 184A (Unilever).

Generally the inorganic builders and other inorganic materials (for example, zeolite, sodium carbonate) are granulated with the surfactants, which act as binders and granulating or agglomerating agents. Any optional ingredients as previously mentioned may be incorporated at any suitable stage in the process.

In accordance with normal detergent powder manufacturing practice, bleach ingredients (bleaches, bleach precursor, bleach stabilisers), proteolytic and lipolytic enzymes, coloured speckles, perfumes and foam control granules are most suitably admixed (postdosed) to the dense homogeneous granular product—the base powder—after it has left the high-speed mixer/granulator.

In these processes, any non-soap anionic surfactant may be already neutralised, that is to say in salt form, when dosed into the high-speed mixer/granulation, or alternatively may be added in acid form and neutralised in situ. The neutralisation of the fatty acid to form soap may take place simultaneously with the neutralisation of the anionic surfactant acid, or quite separately.

In the processes described in EP 544 492A (Unilever), the anionic surfactant (NaPAS) is in neutralised salt form when it encounters the builders, sodium carbonate and other materials in the high-speed mixer. Two different processes are described. In a first process, a homogeneous blend of anionic and nonionic surfactants is prepared by neutralising PAS acid with sodium hydroxide solution in a loop reactor in the presence of the nonionic surfactant; fatty acid may also be present and will also be neutralised by the sodium hydroxide. In a second process, a homogeneous liquid blend of sodium PAS paste, fatty acid, sufficient sodium hydroxide solution to neutralise the fatty acid, and nonionic surfactant is prepared and dosed into the high-speed mixer.

In both cases the liquid surfactant blend contains dissolved sodium fatty acid soap. Processes using mobile surfactant blends are described in more detail in EP 265 203A and EP 507 402A (Unilever).

EP 420 317A and EP 506 184A (Unilever) disclose a different process wherein the acid form of the anionic surfactant, which is a liquid, is mixed and reacted with a solid inorganic alkaline material, such as sodium carbonate, in a continuous high-speed mixer. The resulting granule or "adjunct" is then dosed into another high-speed mixer with the nonionic surfactants and solid ingredients. As in the other neutralisation processes mentioned above, fatty acid and sodium hydroxide may also be incorporated to give fatty acid soap in the final product.

The present invention may be applied to any of these processes, by adjustment of the amount of sodium hydroxide in relation to the amount of fatty acid.

EXAMPLES

The invention is further illustrated by the following non-limiting Examples, in which parts and percentages are by weight unless otherwise stated.

EXAMPLES 1 to 3, COMPARATIVE EXAMPLES A and B

Five detergent powders of high bulk density were prepared to the following general formulation. Base powders were prepared using a continuous high-speed mixer/granulator, and other ingredients were postdosed as shown.

| | Weight % of base | Weight % of total |
|---|---|---|
| Base | | |
| CocoPAS | 9.10 | 5.81 |
| Nonionic (7EO) | 9.10 | 5.81 |
| Nonionic (3EO) | 11.51 | 7.35 |
| Zeolite MAP | 56.42 | 36.04 |
| Sodium carbonate | 1.50 | 0.96 |
| Fatty acid | 2.94 | 2.04 |
| Sodium hydroxide | see below | see below |
| Sodium carboxymethylcellulose | 1.39 | 0.89 |
| Moisture to 100 wt % | | |
| Total | 100.00 | 63.88 |
| Postdosed | | |
| Sodium percarbonate | | 20.50 |
| TAED | | 4.75 |
| Bleach catalyst | | 2.40 |
| EDTMP (Dequest 2047) | | 0.37 |
| Sodium silicate | | 2.90 |
| Enzymes | | 1.75 |
| Antifoam/fluorescer | | 3.00 |
| Perfume | | 0.45 |
| | | 100.00 |

Sodium hydroxide was included in the base powder as shown in Table 1, which also shows the total soluble sodium and "basic sodium" for each formulation.

The sodium ion attributable to each component was calculated using the following molecular weight data (atomic weight of sodium=23):

| | molecular weight | proportion of Na |
|---|---|---|
| cocoPAS | 307 | 0.075 |
| NaOH | 40 | 0.575 |
| SCMC | 320 | 0.067 |
| Na carbonate | 106 | 0.217 |
| Fatty acid ($C_{18}$) | 298 | — |
| Soap | 320 | 0.067 |

The measured values for total sodium and "basic sodium" were determined as follows.

Total sodium 10 g of detergent base powder was dissolved in 500 ml of demineralised water at 50° C., the solution was filtered through a 10-micrometer filter, and a 100 ml aliquot of the filtered solution was centrifuged at 20 000 G for 30 minutes to remove all suspended matter. The dissolved sodium and potassium contents of the supernatant solution were then measured by atomic absorption spectroscopy.

"Basic sodium"

After determination of the total sodium as above, the prepared solution was potentiometrically titrated with 0.1 molar hydrochloric acid and the equivalence point determined, the "basic sodium" being the calculated molar sodium equivalent of the basic anions (hydroxide and carbonate) at the equivalence points, then converted to weight percent for convenience.

TABLE 1

| sodium (calculated and measured) | A | B | 1 | 2 | 3 |
|---|---|---|---|---|---|
| NaOH added | | | | | |
| (wt % of base) | 0.44 | 0.67 | 0.38 | 0.29 | 0.22 |
| x stoich. | 1.00 | 1.50 | 0.85 | 0.65 | 0.50 |
| Soluble sodium (wt % of base) | | | | | |
| (a) from NaOH | 0.256 | 0.383 | 0.217 | 0.166 | 0.128 |
| (b) from carbonate | 0.326 | 0.326 | 0.326 | 0.326 | 0.326 |
| (c) from PAS | 0.682 | 0.682 | 0.682 | 0.682 | 0.682 |
| (d) from SCMC | 0.093 | 0.093 | 0.093 | 0.093 | 0.093 |
| total calculated (a) + (b) + (c) + (d) | 1.359 | 1.484 | 1.318 | 1.267 | 1.229 |
| measured | 1.522 | 1.640 | 1.516 | 1.390 | 1.340 |
| Basic sodium | | | | | |
| (f) total basic Na (a) + (b) | 0.582 | 0.709 | 0.543 | 0.492 | 0.454 |
| (e) Na neutralised by fatty acid | 0.212 | 0.212 | 0.212 | 0.212 | 0.212 |
| Residual basic Na calc.(f) − (e) | 0.370 | 0.496 | 0.332 | 0.281 | 0.242 |
| measured | 0.410 | 0.560 | 0.390 | 0.310 | 0.260 |

It will be seen that the measured value is consistently slightly higher than the calculated value. This may be attributed principally to residual sodium hydroxide associated with the zeolite in the formulation.

Powder yellowing

Powder yellowing was assessed visually, at three stages:

(a) initially, in the fresh powder;

(b) after one week's storage at 37° C. and 70% relative humidity, and (c) after two weeks' storage at 37° C. and 70% relative humidity.

The frequency of occurrence of yellow particles in the powder was scored on a scale of 1 to 4 as follows:

1 No yellow particles visible.

2 A few yellow particles visible.

3 Yellow particles visible.

4 Many yellow particles visible.

The intensity of colour of the yellow particles was scored on a scale of 0 to 3, as follows:

0 Off-white.

1 Pale yellow.

2 Yellow.

3 Bright yellow.

Results are shown in Table 2 below.

TABLE 2

| | particle yellowing | | | | |
|---|---|---|---|---|---|
| Example | A | B | 1 | 2 | 3 |
| Frequency: | | | | | |
| initial | 1 | 1 | 1 | 1 | 1 |
| after 1 week | 3 | 4 | 2 | 2 | 1 |
| after 2 weeks | 3 | 4 | 2 | 2 | 2 |
| Intensity: | | | | | |
| initial | 0 | 0 | 0 | 0 | 0 |
| after 1 week | 3 | 3 | 1 | 1 | 0 |
| after 2 weeks | 3 | 3 | 2 | 1 | 1 |

It will be seen that particle yellowing was much reduced both in frequency and in intensity in the powders having low "basic sodium".

Bleach stability

Bleach storage stability was assessed by measuring percentage of initial activity after 10 weeks' storage at 37° C. in sealed bottles (6 g powder samples were stored in 50 g bottles). The results are shown in Table 3. For sodium percarbonate, these are available oxygen values; while for TAED they represent the level of peracetic acid generated on reaction with hydrogen peroxide.

TABLE 3

| sodium percarbonate and TAED stability | A | B | 1 | 2 | 3 |
|---|---|---|---|---|---|
| Percarbonate | 69 | 65 | 71 | 78 | 84 |
| TAED | 61 | 60 | 63 | 70 | 75 |

Powder properties

The powder properties (flow, particle size, particle size distribution) were also investigated.

For the purposes of the present invention, powder flow is defined in terms of the dynamic flow rate, in ml/s, measured by means of the following procedure. The apparatus used consists of a cylindrical glass tube having an internal diameter of 35 mm and a length of 600 mm. The tube is securely clamped in a position such that its longitudinal axis is vertical. Its lower end is terminated by means of a smooth cone of polyvinyl chloride having an internal angle of 15° and a lower outlet orifice of diameter 22.5 mm. A first beam sensor is positioned 150 mm above the outlet, and a second beam sensor is positioned 250 mm above the first sensor.

To determine the dynamic flow rate of a powder sample, the outlet orifice is temporarily closed, for example, by covering with a piece of card, and powder is poured through a funnel into the top of the cylinder until the powder level is about 10 cm higher than the upper sensor; a spacer between the funnel and the tube ensures that filling is uniform. The outlet is then opened and the time t (seconds) taken for the powder level to fall from the upper sensor to the lower sensor is measured electronically. The measurement is normally repeated two or three times and an average value taken.

If V is the volume (ml) of the tube between the upper and lower sensors, the dynamic flow rate DFR (ml/s) is given by the following equation:

$$DFR = \frac{V}{t} \text{ ml/s}$$

The averaging and calculation are carried out electronically and a direct read-out of the DFR value obtained.

TABLE 2

| | powder properties | | | | |
|---|---|---|---|---|---|
| Example | A | B | 1 | 2 | 3 |
| Bulk density (g/l) | 890 | 898 | 885 | 895 | 886 |
| Dynamic flow rate (ml/s) | 130 | 151 | 126 | 102 | 72 |
| Average particle size (μm) | 570 | 698 | 670 | 665 | 802 |
| Fines (wt % <180 μm) | 5.5 | 4.7 | 3.9 | 2.0 | 9.4 |

It will be seen that bulk densities were little affected by "basic sodium" level, but dynamic flow rate fell as the extent of neutralisation of the fatty acid (to the structurant soap) was reduced. The flow rates of the powders of Examples 1 and 2 were still good, but that of the powder of Example 3 had fallen to an unacceptable level. Average particle size and "fines" content had also risen to values larger than optimal. Therefore, for this particular formulation, Example 3 was not optimum despite the reduced fluorescer yellowing and improved bleach stability.

Delivery into the wash

Delivery into the wash, dispersion and dissolution characteristics were measured by three different tests.

Test 1: cage test

Delivery characteristics of the powders were compared using a model system which simulates the delivery of a powder in an automatic washing machine, under more adverse conditions (low temperature, minimal agitation) than those normally encountered in a real wash situation.

For this test a cylindrical vessel having a diameter of 4 cm and a height of 7 cm, made of 600 micrometer pore size stainless steel mesh, and having a top closure made of Teflon and a bottom closure of the mesh just described, was used. The top closure had inserted therein a 30 cm metal rod to act as a handle, and this handle was attached to an agitator arm positioned above 1 liter of water at 20° C. in an open container. By means of this agitator apparatus the cylindrical vessel, held at 45 degrees, could be rotated through a circle with a 10 cm radius over a period of 2 seconds and allowed to rest for 2 seconds, before the start of the next rotation/rest cycle.

A 50 g powder sample was introduced into the cylindrical vessel which was then closed. The vessel was attached to the agitator arm which was then moved down to a position such that the top of the cylindrical vessel was just below the surface of the water. After a 10 second delay, the apparatus was operated for 15 rotation/rest cycles.

The cylindrical vessel and handle were removed from the water and and the vessel detached from the handle. Surface water was carefully poured off, and any powder residues transferred to a preweighed container and dried for 24 hours at 100° C. The weight of dried residue as a percentage of the initial powder weight (50 g) was then calculated. Results were as follows:

| Example | A | B | 1 | 2 | 3 |
|---|---|---|---|---|---|
| Residue (wt %) | 58 | 33 | 23 | 21 | 38 |

It will be seen that the powders of Examples 1 and 2 gave the best results in this test. The powder of Example 3 having a very low "basic sodium" level gave a result comparable to that of the powders having high "basic sodium".

Test 2; delivery device test

Delivery characteristics of the powders were also compared using a model system which emulates the delivery of a powder in an automatic washing machine from a flexible delivery device of the type supplied with Lever's Persil (Trade Mark) Micro System powder in the UK: a spherical container of flexible plastics material having a diameter of approximately 4 cm and a top opening of diameter approximately 3 cm.

In this test the delivery device was attached in an upright position (opening uppermost) to an agitator arm positioned above water. By means of this apparatus the device could be moved vertically up and down through a distance of 30 cm, the lowest 5 cm of this travel being under water. Each up or down journey had a duration of 2 seconds, the device being allowed to rest 5 cm under water for 4 seconds at the lowest position, and at the highest position being rotated through 100° and allowed to rest in the resulting tilted orientation for 2 seconds before redescending. 5 liters of water at a temperature of 20° C. were used.

A preweighed powder sample was introduced into the device in its highest position, and the apparatus then allowed to operate for six cycles and stopped when the device was again in its highest position. Surface water was carefully poured off, and any powder residues transferred to a preweighed container. The container was then dried at 100° C. for 24 hours, and the weight of dried residue as a percentage of the initial powder weight calculated.

Results were as follows:

| Example | A | B | 1 | 2 | 3 |
|---|---|---|---|---|---|
| Residue (wt %) | 11 | 16 | 0 | 0 | 0 |

In this test all the powders with low "basic sodium" gave good results.

Test 3: black pillowcase test

A washing machine test was also used to determine the extent that insoluble residues were deposited on washed articles. The machine used was a Siemens Siwamat (Trade Mark) Plus 3700 front-loading automatic washer and the test methodology was as follows.

A 100 g dose of powder was placed in a flexible delivery device as described previously. The delivery device was placed inside a black cotton pillowcase having dimensions of 30 cm by 60 cm, taking care to keep it upright, and the pillowcase was then closed by means of a zip fastener. The pillowcase containing the (upright) delivery device was then placed on top of a 3.5 kg dry cotton washload in the drum of the washing machine.

The machine was operated on the "heavy duty cycle" at a wash temperature of 60° C., using water of 15° French hardness and an inlet temperature of 20° C. At the end of the wash cycle the pillowcase was removed, opened and turned inside out, and the level of powder residues on its inside surfaces determined by visual assessment using a scoring system of 1 to 3: a score of 3 corresponds to a residue of approximately 75 wt % of the powder, while 1 indicates no residue. A panel of five assessors was used to judge each pillowcase and allot a score. With each powder the wash process was carried out ten times and the scores were averaged over the ten repeats.

The results were as follows:

| Example | A | B | 1 | 2 | 3 |
|---|---|---|---|---|---|
| Score | 1.0 | 1.6 | 0.5 | 0.5 | 0.8 |

Again the powders of Examples 1 and 2 gave the best results, with residues creeping up again when the "basic sodium" level was further reduced.

EXAMPLES 4 and 5, COMPARATIVE EXAMPLE D

The following Examples relate to powders containing nonionic surfactant only.

Base powders were prepared by mixing and granulation to the formulations shown in Table 4, which also gives "basic sodium" levels and powder properties.

TABLE 4 formulations and powder properties

| | D | 4 | 5 |
|---|---|---|---|
| Nonionic surfactant (coconut 5EO) | 31.1 | 29.4 | 27.8 |
| Fatty acid/soap* ($C_{16-18}$ saturated) | 6.8 | 6.8 | 6.8 |
| Zeolite MAP | 54.8 | 56.8 | 59.5 |
| Fluorescer: | | | |
| Tinopal CBS-X | 0.02 | 0.02 | 0.02 |
| Tinopal DMS-X | 0.36 | 0.36 | 0.36 |
| Water | 6.92 | 6.62 | 6.32 |
| *Extent of neutralisation of fatty acid | 1.0 | 0.5 | 0.0 |
| Measured "basic sodium" | 0.44 | 0.36 | 0.25 |
| Bulk density (g/l) | 885 | 845 | 775 |
| Dynamic flow rate (ml/s) | 144 | 144 | 142 |

For bleach stability testing, 6 g samples of the powders were each mixed with 1.7 g of sodium percarbonate (uncoated), and 0.4 g of granular TAED (83 wt % active).

The results after 10 weeks' storage at 37° C. in sealed 50 g bottles were as shown in Table 5.

TABLE 5 bleach stability

| | D | 4 | 5 |
|---|---|---|---|
| Percarbonate stability (% of initial $AvO_2$ after 10 weeks) | 68 | 83 | 92 |
| TAED stability (% of initial peracetic acid generation after 10 weeks) | 60 | 72 | 88 |

We claim:

1. A process for the preparation of a particulate detergent composition having a bulk density of at least 600 g/l, which comprises mixing and granulating:

(a) one of more organic non-soap surfactants, optionally including one or more anionic surfactants in free acid form, (b) one or more detergency builders comprising sodium aluminosilicate, (c) fatty acid, (d) optionally sodium carbonate, (e) optionally water and minor detergent ingredients, (f) sodium hydroxide in an amount equal to not more than 0.90 times the stoichiometric amount required to neutralise the fatty acid, whereby a substantially homogeneous granular detergent base composition having a bulk density of at least 600 g/l is formed, whereby neutralisation of the fatty acid to soap is effected, and whereby any anionic surfactant initially present in free acid form is converted to sodium salt form; and optionally admixing further detergent ingredients to form a product.

2. A process as claimed in claim 1, wherein the granular base comprises:

(a) from 10 to 50 wt % of the organic surfactant system, (b) from 5 to 80 wt % of the builder system, comprising from 10 to 70 wt % of sodium aluminosilicate, (c) from 1 to 10 wt % of fatty acid soap, (d) from 0 to 20 wt % of sodium carbonate, (e) water and optional minor ingredients to 100 wt %.

3. A process as claimed in claim 2, wherein the granular base comprises from I to 5 wt % of fatty acid soap (c).

4. A process as claimed in claim 1, wherein the organic surfactant system includes an ethoxylated alcohol nonionic surfactant.

5. A process as claimed in claim 1, wherein the organic surfactant system includes one or more anionic surfactants selected from the group consisting of primary alcohol sulphates and linear alkylbenzene sulphonates.

6. A process as claimed in claim 1, wherein the detergency builders comprise zeolite P having a silicon to aluminum ratio not exceeding 1.33 (zeolite MAP).

7. A process as claimed in claim 1, whereby a detergent composition is formed comprising:

(i) from 40 to 95 wt % of the homogeneous granular base, (ii) optionally from 5 to 35 wt % of a peroxy bleach compound, (iii) optionally from 1 to 8 wt % of a peracid precursor, (iv) optionally from 0.01 to 1 wt % of a fluorescer, optionally within the homogenous granular base, (v) optional minor ingredients to 100 wt %.

8. A process as claimed in claim 1, wherein the sodium hydroxide (f) is used in an amount equal to from 0.60 to 0.90 times the stoiochiometric amount required to neutralise the fatty acid.

9. A process as claimed in claim 1, wherein the mixing and granulation are carried out in a high-speed mixer/granulator having both a stirring and a cutting action.

10. A process as claimed in claim 1, wherein the granular detergent base formed has a level of "basic sodium", defined as the amount of sodium ion associated with the basic anions, hydroxide and carbonate, that can be recovered from a solution of said base, not exceeding 0.4 wt %.

11. A process as claimed in claim 10, wherein the granular base has a level of "basic sodium" within the range of from 0.25 to 0.4 wt %.

12. A process as claimed in claim 10, wherein the granular base has a level of "basic sodium" within the range of from 0.3 to 0.4 wt %.

13. A process as claimed in clam 10, wherein the granular base has a level of "basic sodium" within the range of from 0.31 to 0.39 wt %.

* * * * *